US008918201B2

(12) United States Patent
Stanikowski et al.

(10) Patent No.: US 8,918,201 B2
(45) Date of Patent: Dec. 23, 2014

(54) METHOD AND SYSTEM FOR ARRANGING ROD-LIKE ELEMENTS

(71) Applicant: International Tobacco Machinery Poland Sp. z o.o., Radom (PL)

(72) Inventors: Andrzej Stanikowski, Radom (PL); Robert Chmielewski, Jedlnia Letnisko (PL); Wojciech Jerzy Chojnacki, Radom (PL); Andrzej Sulkowski, Jedlinsk (PL); Marek Sieredzinski, Radom (PL); Krzysztof Stolarski, Radom (PL)

(73) Assignee: International Tobacco Machinery Poland Sp. z o.o., Radom (PL)

( * ) Notice: Subject to any disclaimer, the term of this patent is extended or adjusted under 35 U.S.C. 154(b) by 42 days.

(21) Appl. No.: 13/734,389

(22) Filed: Jan. 4, 2013

(65) Prior Publication Data

US 2013/0268112 A1 Oct. 10, 2013

(30) Foreign Application Priority Data

Jan. 5, 2012 (PL) ..... 397717

(51) Int. Cl.

| | |
|---|---|
| ***G06F 7/00*** | (2006.01) |
| ***A24B 3/00*** | (2006.01) |
| ***A24C 5/36*** | (2006.01) |

(52) U.S. Cl.

CPC .... *A24B 3/00* (2013.01); *A24C 5/36* (2013.01)
USPC ..... 700/214; 700/213; 700/216; 700/219; 700/222; 700/223; 700/228

(58) Field of Classification Search

None
See application file for complete search history.

(56) References Cited

U.S. PATENT DOCUMENTS

| | | | | |
|---|---|---|---|---|
| 3,233,613 | A | 2/1966 | Körber et al. | |
| 3,404,688 | A | 10/1968 | Pinkham et al. | |
| 4,362,235 | A * | 12/1982 | Erdmann | 198/418.3 |
| 5,076,291 | A | 12/1991 | Grove et al. | |

(Continued)

FOREIGN PATENT DOCUMENTS

| | | |
|---|---|---|
| DE | 1106 227 | 9/1957 |
| DE | 15 32 254 A1 | 1/1970 |

(Continued)

OTHER PUBLICATIONS

European Search Report issued in corresponding European Application No. EP 13 15 0232 dated Apr. 13, 2013 (4 pgs).

(Continued)

*Primary Examiner* — Yolanda Cumbess
(74) *Attorney, Agent, or Firm* — Nixon & Vanderhye P.C.

(57) ABSTRACT

Method and system for arranging rod-like elements, in which an unordered portion of rod-like elements, composed each of at least one part selected from cigarette parts being filter parts and tobacco parts, is delivered to a conveyor which arranges the elements on the conveyor in a plurality of compartments, longitudinally in each compartment and transversely to the direction of movement of the conveyor. The compartments have a length which receives at least one filter part and at least one tobacco part of a cigarette. The type, number and location of parts of the element received in each compartment is defined by at least a single scanning of each successive compartment of the conveyor. The result of the scanning is transmitted to a control unit and the elements are subsequently sorted based on information received from the control unit.

20 Claims, 11 Drawing Sheets

(56) References Cited

U.S. PATENT DOCUMENTS

| | | | | |
|---|---|---|---|---|
| 2001/0003891 | A1* | 6/2001 | Meis | 53/444 |
| 2006/0180166 | A1 | 8/2006 | Bencivenni et al. | |
| 2006/0180167 | A1* | 8/2006 | Spatafora et al. | 131/280 |

FOREIGN PATENT DOCUMENTS

| | | | |
|---|---|---|---|
| DE | 15 32 283 | A1 | 1/1970 |
| DE | 44 46 323 | A1 | 6/1996 |
| DE | 20 2005 010 375 | U1 | 11/2005 |
| EP | 0 436 304 | A1 | 7/1991 |
| GB | 850 332 | A | 10/1960 |
| NL | 7511218 | A | 3/1976 |
| PL | 362495 | A1 | 4/2004 |
| RU | 2226968 | | 4/2004 |
| SU | 141087 | | 11/1961 |
| WO | WO 01/89329 | | 5/2001 |

OTHER PUBLICATIONS

Decision on patent grant issued Jul. 4, 2014, Application No. 2012155784/12(088311) filed Dec. 24, 2012 (10 pages).

* cited by examiner

METHOD AND SYSTEM FOR ARRANGING ROD-LIKE ELEMENTS

The present invention relates to a method and a system for arranging rod-like elements constituting production waste in tobacco industry.

BACKGROUND OF THE INVENTION

Devices for cutting cigarette tobacco parts off their filter parts are known in the art.

Document U.S. Pat. No. 3,404,688 discloses a device for cutting open the elements of so called "double cigarettes" containing a double filter part and two tobacco parts. Such elements are cut open if their tobacco parts have been filled with the tobacco in a faulty manner.

Document U.S. Pat. No. 3,233,613 discloses a device for cutting open both double and regular cigarettes not fulfilling quality requirements.

The device disclosed in U.S. Pat. No. 5,076,291 enables cutting open defective regular cigarettes that are not arranged in any orderly manner, i.e. having their filter parts oriented in both possible directions.

Document DE 1106227 presents a device for cutting cigarette tobacco parts off their filter parts, the device requiring an orderly arrangement of the cigarettes with their filters oriented in one direction according to the position of a disc knife used for cutting the cigarette parts.

Devices for arranging rod-like waste elements constituting a mixture of various types of elements, i.e. a mixture of both single and double cigarettes as well as separate filter and tobacco parts, are not known in the art.

SUMMARY OF THE INVENTION

The object of the invention is to provide a system and a method for arranging rod-like waste elements produced at various stages of a cigarette production process.

According to the invention a method of arranging rod-like elements is provided, in which an unordered portion of rod-like elements composed each of at least one part selected from a group including cigarette parts being filter parts and tobacco parts, is delivered to a conveyor enabling arrangement of the elements on the said conveyor in a plurality of compartments, longitudinally in each compartment and transversely to the direction of movement of the conveyor, the compartments having a length adapted to receive at least one filter part and at least one tobacco part of a cigarette.

The method is characterized in that the type, the number and the location of parts of the element received in each successive compartment is defined by at least a single scanning of each successive compartment of the conveyor, the result of the scanning being transmitted to a control unit in which each compartment is assigned information about its contents, the elements being subsequently sorted out, basing on the information received from the control unit, by the type and the number of parts each element is composed of, as well as by the location of these parts in the compartment, by transferring the elements contained in successive compartments to suitable receiving means selected according to the information received from the control unit.

Preferably, each compartment of the conveyor has a length which comprises a multiple of a sum of the length of the filter part and the tobacco part of an element.

The scanning is preferably performed by means of a longitudinal scanning head located immovably above the conveyor and extending in a direction along the compartments.

The scanning of each compartment may be effected by separate scanning of its individual adjoining sectors, each sector having a length equal at most to the length of the filter part of a cigarette.

Preferably, each compartment is scanned more than once by means of a sliding scanning head moving above the conveyor and along it.

Preferably, a scanning head is used enabling detecting at least one of the features selected from a group containing: presence or absence of an element in a compartment, external color of the element, density of the contents of the element, contrast of the scanned elements, presence of a detectable indicator on the element.

The successive elements are preferably sorted out and transferred to a suitable receiving means by locating them in separate chambers of the receiving means, the chambers collecting the elements selected from the groups containing: elements composed of two tobacco parts combined with two filter parts, elements composed of one tobacco part combined with two filter parts, the tobacco part of which being located on a first side of the compartment, elements composed of one tobacco part combined with two filter parts, the tobacco part of which being located on an opposite side of the compartment, elements composed exclusively of filter parts, elements composed of a tobacco part combined with a filter part, the tobacco part of which being located on a first side of the compartment, elements composed of a tobacco part combined with a filter part, the tobacco part of which being located on a second side of the compartment, elements composed exclusively of tobacco parts, the elements from the compartments in which more than one element is detected being returned and placed back on the conveyor.

The rod-like elements are preferably transferred to the receiving means by feeding means comprising compressed air nozzles or pushers.

According to another aspect of the invention a system is provided for arranging rod-like elements composed each of at least one part selected from a group including cigarette parts being filter parts and tobacco parts, comprising a conveyor on which an unordered portion of the rod-like elements is delivered, the conveyor enabling arrangement of the elements in a plurality of compartments, longitudinally in each compartment and transversely to the direction of movement of the conveyor, the compartments having a length adapted to receive at least one filter part and at least one tobacco part of a cigarette.

The system is characterized in that a scanning means is located above the conveyor enabling at least a single scanning of each successive compartment of the conveyor and definition of the type, the number and the location of the parts of an element received in each successive compartment, the system being further provided with a control unit assigning each compartment the information about its contents, and in that the system is further provided with feeding means and receiving means for the elements which are sorted out basing on the information received from the control unit, by the type and the number of the parts an element is composed of, as well as by the location of these component parts within the compartment, the feeding means and the receiving cooperating with the control unit.

The conveyor is preferably a belt conveyor or a drum conveyor.

The control unit is preferably a programmable controller or an industrial computer.

The scanning means may be constituted by a longitudinal scanning head located immovably above the conveyor and extending in a direction along the compartments.

Each compartment of the conveyor has preferably a length able to receive at most one filter part and one tobacco part of an element.

Each compartment of the conveyor may have a length that comprises a multiple of a sum of the length of the filter part and the tobacco part of an element.

The scanning means may have a form of a sliding scanning head movable above the conveyor and along it.

The scanning head preferably comprises a plurality of scanning sections, each scanning section comprising a sensor adapted to detect at least one of the features selected from a group containing: presence or absence of an element in a compartment, external color of the element, density of the contents of the element, contrast of the scanned elements, presence of a detectable indicator on the element.

The receiving means preferably comprise preferably containers, receiving channels or conveyors into which the elements are fed from the individual compartments of the conveyor via the channels.

The receiving means preferably comprise separate chambers collecting the elements selected from the groups containing: elements composed of two tobacco parts combined with two filter parts, elements composed of one tobacco part combined with two filter parts, the tobacco part of which being located on a first side of the compartment, elements composed of one tobacco part combined with two filter parts, the tobacco part of which being located on an opposite side of the compartment, elements composed exclusively of filter parts, elements composed of a tobacco part combined with a filter part, the tobacco part of which being located on a first side of the compartment, elements composed of a tobacco part combined with a filter part, the tobacco part of which being located on a second side of the compartment, elements composed exclusively of tobacco parts.

The feeding means may comprise compressed air nozzles or pushers.

The system according to the invention may be associated with a cutting unit for separating the tobacco parts from the filter parts.

The invention provides an advantageous possibility of arranging in an orderly way any waste coming from a cigarette production process as well as any other rod-like products of tobacco industry in such a way that the individual elements are sorted out in separate containers, conveyors, channels etc.

BRIEF DESCRIPTION OF THE DRAWINGS

An exemplary embodiment of the system and the method of the invention is illustrated in the drawing, in which.

DETAILED DESCRIPTION OF PREFERRED EMBODIMENTS

Figure 1A:
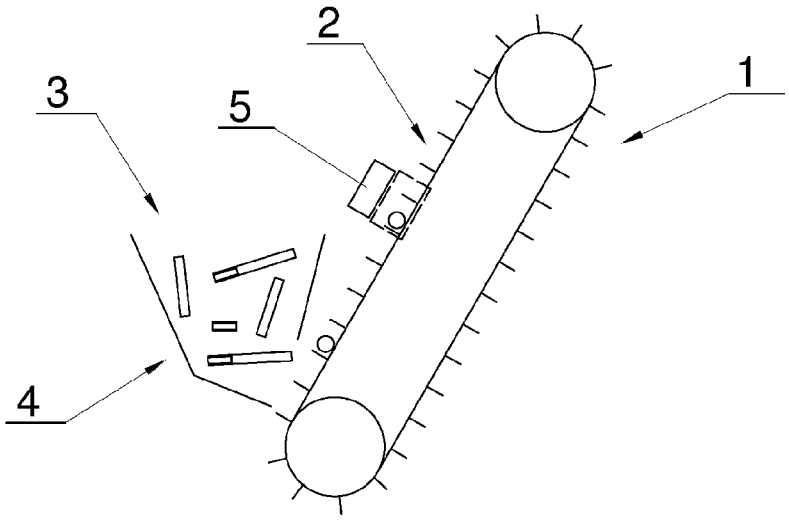
FIGS. 1*a*-1*b* show exemplary conveyors of an exemplary system according to the invention.
Figure 1B:
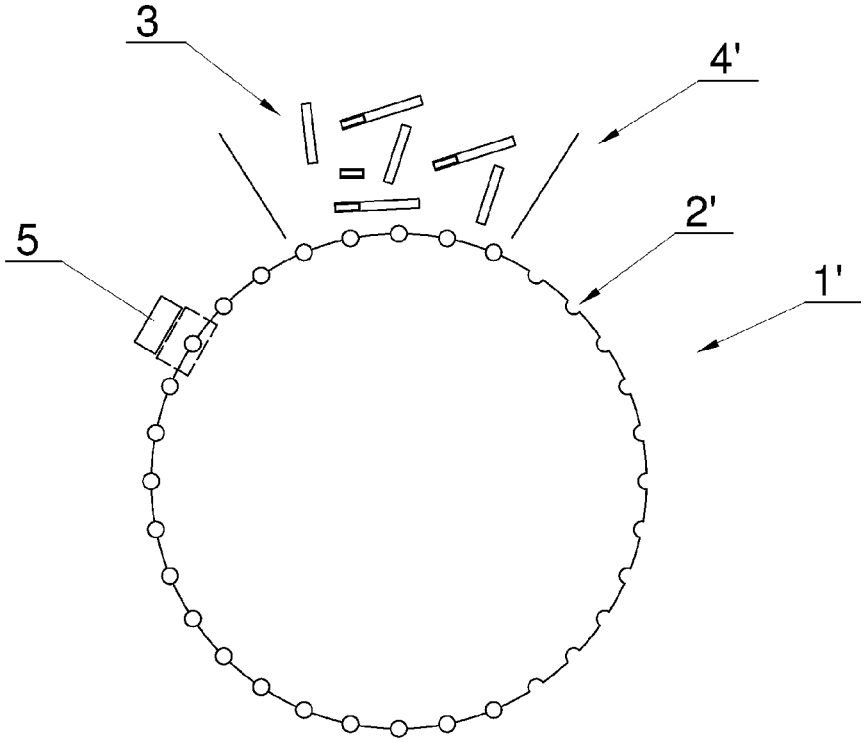

FIGS. 1*a* and 1*b* illustrate exemplary conveyors that may constitute a part of an exemplary system according to the invention. FIG. 1*a* shows an example of a belt conveyor 1, while FIG. 1*b* shows an example of a drum conveyor 1'. Both types of the conveyors are provided with compartments 2, 2' into which rod-like elements, in particular cigarette production waste rod-like elements 3, are fed. Waste elements 3 are placed in a chute 4 from which they are fed to the compartments 2, 2' of the conveyor 1, 1'.

Figure 2:
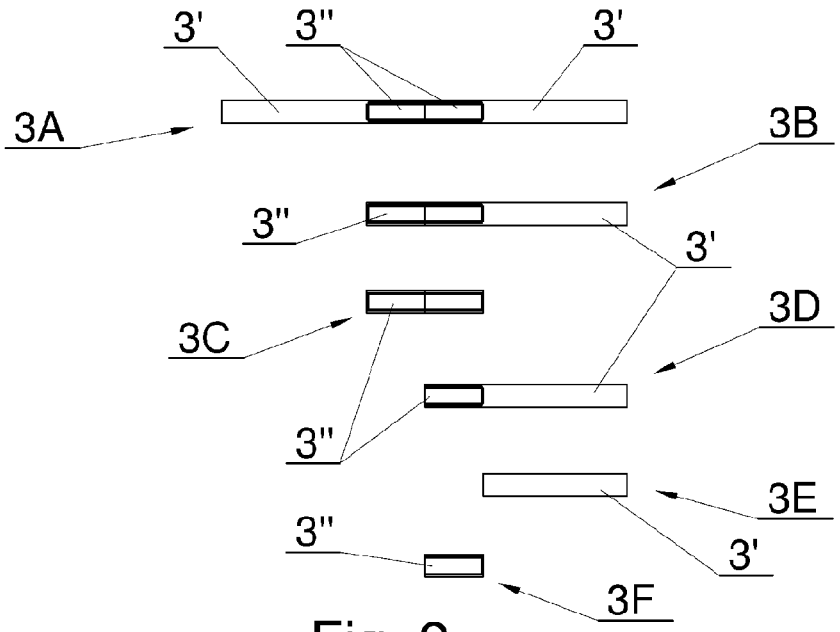
FIG. 2 shows various types of rod-like waste elements.

FIG. 2 illustrates examples of rod-like elements 3 being waste products of the cigarette production process, the elements including:

- elements 3A consisting of two tobacco parts 3' combined with two filter parts 3" constituting two cigarettes connected with each other, i.e. non-separated;
- elements 3B consisting of one tobacco part 3' combined with two filter parts 3";
- elements 3C consisting of two filter parts 3" connected with each other, i.e. non-separated;
- elements 3D consisting of one tobacco part 3' combined with one filter part 3" constituting a complete cigarette;
- elements 3E consisting of just one tobacco part 3';
- elements 3F consisting of just one filter part 3'.

Figure 3:
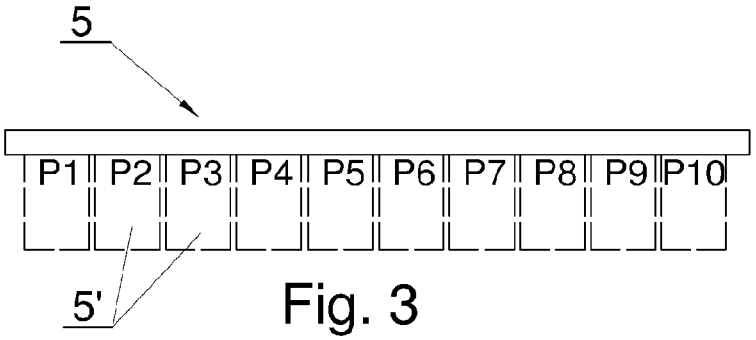
FIG. 3 shows a side view of an exemplary scanning head of the shown exemplary system according to the invention.

FIG. 3 presents an exemplary scanning head 5 belonging to the system according to the invention. The scanning head 5 comprises a plurality of scanning sections 5', e.g. sections P1 to P10, each scanning section 5' may be provided with various types of sensors adapted to detect, among others, the presence or absence of an object in the scanned area, the external color of the scanned object, the contrast of the scanned objects, the density of the contents of the object, or to read special indicators provided on the object.

Figure 4:
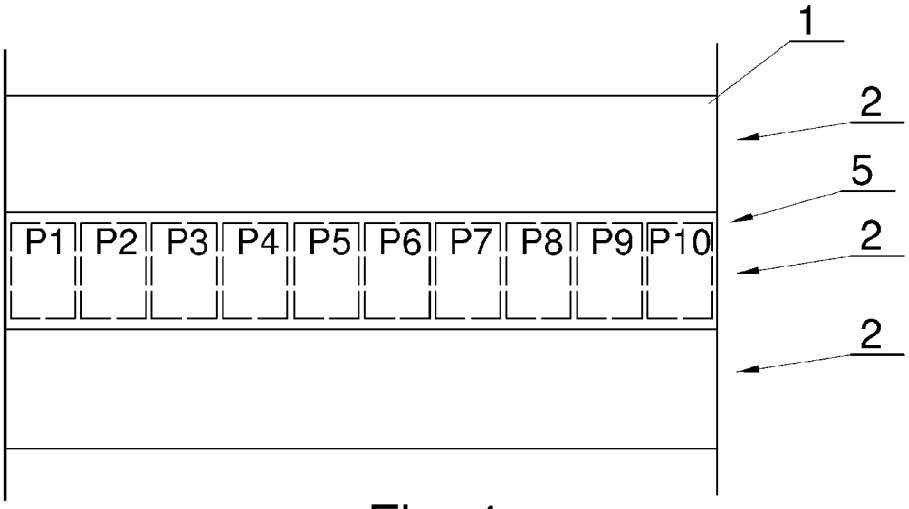
FIG. 4 shows a top view of the scanning head.

FIG. 4 shows a top view of the scanning head 5 located above the conveyor 1, the scanning head 5 being positioned along successive moving compartments 2 in which waste elements 3 are received. The scanning head 5 may be stationary or slidable and may be adapted to be movable in order to perform the scanning in the direction of the conveyor movement. Additionally it may be movable along the compartments 2.

Figure 5:
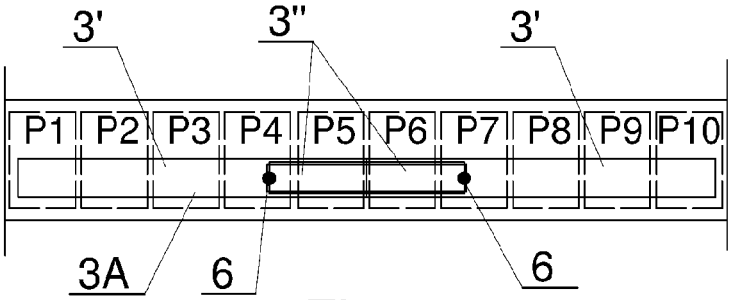
FIGS. 5-8 show examples of rod-like waste elements scanned by the scanning head.

FIGS. 5-8 show examples of waste elements 3 scanned by the scanning head 5. FIG. 5 shows an element 3A consisting of two tobacco parts 3' combined with two filter parts 3", the scanning head being adapted to scan, among others, the indicators 6 that have been intentionally applied onto the surface of the element e.g. close to the connection of the tobacco part 3' with the filter part 3". All the scanning sections will detect the presence of the element 3A, while the scanning sections 5', P4 to P7 will detect the presence of the filter parts 3", the sections P4 and P7 will detect the presence of the indicators, and the sections P1, P2, P3, P8, P9 and P10 will detect the presence of the tobacco parts 3'. The result of the scanning is transmitted to a control unit S shown in FIG. 9, and the scanned compartment is assigned the information about its contents. The control unit S may be a programmable controller or an industrial computer.

Figure 6:
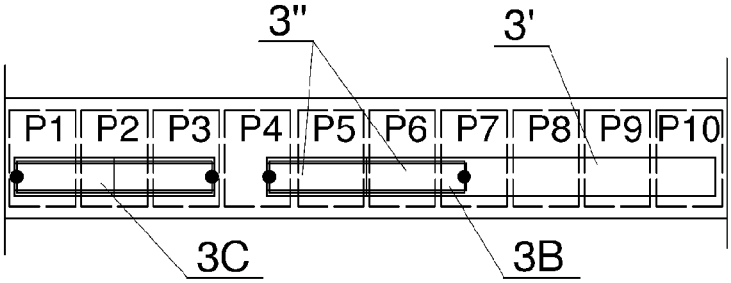
Figure 7:
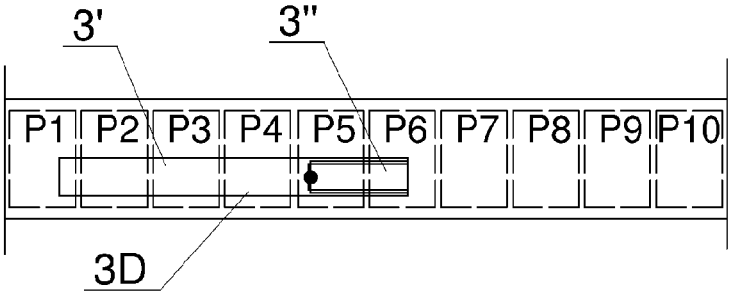
Figure 8:
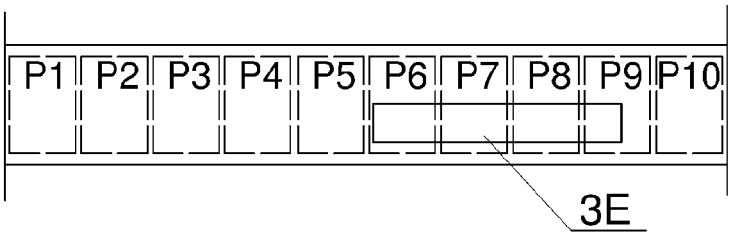

As shown in FIG. 6 a waste element 3B and a waste element 3C are received in another exemplary compartment 2 of the conveyor 1. The scanning sections 5', P1, P2 and P3 will detect the presence of the filter parts 3", and the sections P1 and P3 will detect the presence of the indicators 6. The section P4 will detect the presence of a fragment of the filter part 3" and the presence of the indicator 6, the sections P4, P5, P6 and P7 will detect the presence of the filter parts 3", the section P7 will detect the presence of the indicator 6, while the sections P7, P8, P9 and P10 will detect the presence of the tobacco part 3'. In another exemplary compartment 2 of the conveyor 1, shown in FIG. 7, there is a waste element 3C, The sections P1 to P6 will detect the presence of the waste element, the sections P1 to P4 will detect the presence of the tobacco part 3', the sections P5 and P6 will detect the presence of the tobacco part 3', while the section P5 will detect the presence of the indicator 6. The scanning sections 5', P6 to P9 in FIG. 8 will detect the presence of the filter part 3" of the waste element 3F, and the remaining scanning sections 5' will detect the absence of elements. In each of the above described examples, the control unit receives the information about the type(s) of the waste element 3 and about its position in the compartment.

Figure 9:
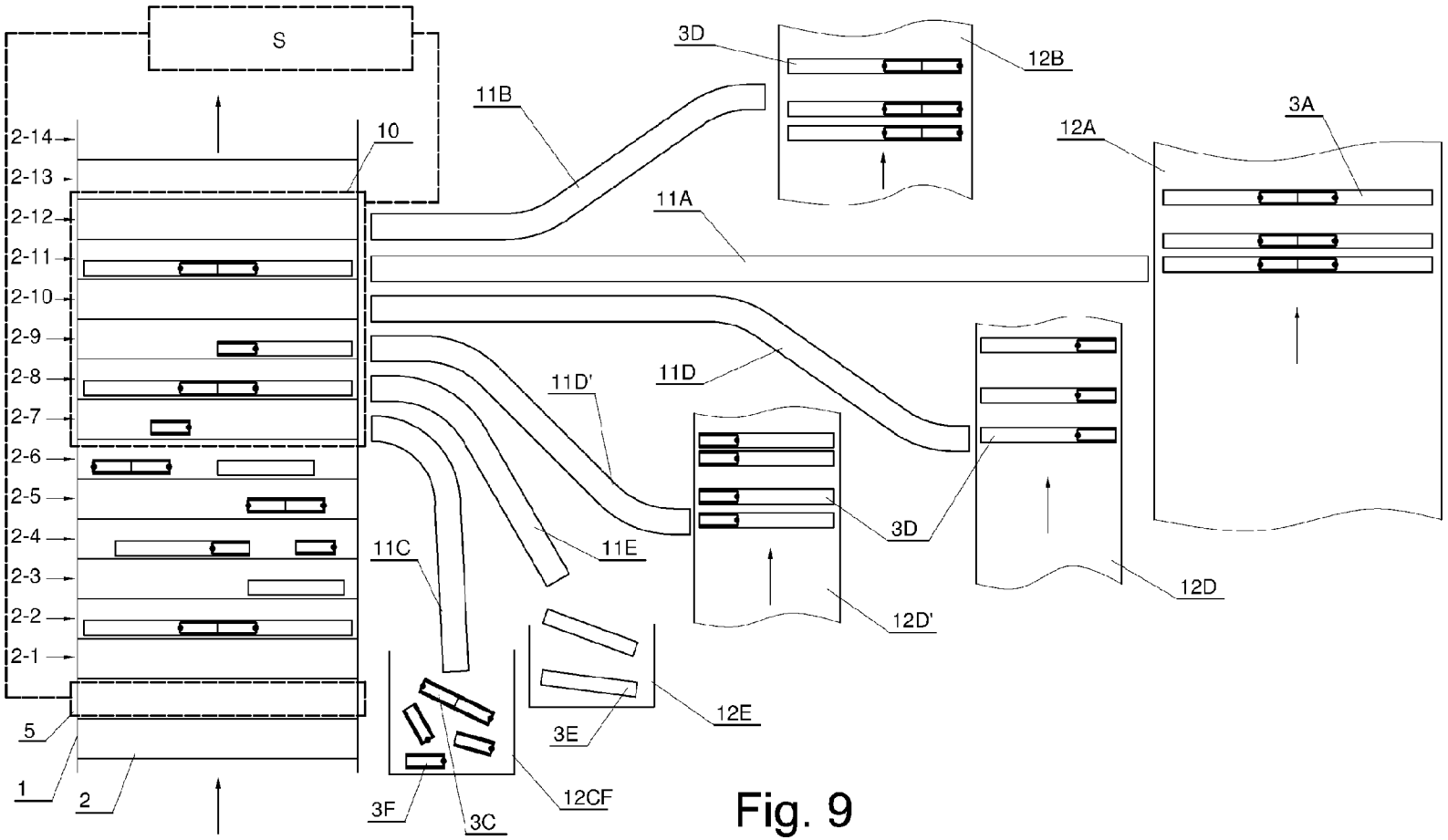
FIG. 9 schematically shows an exemplary embodiment of the system according to the invention.

FIG. 9 schematically illustrates an exemplary embodiment of the system according to the invention. FIG. 9 shows how the waste elements 3 of various types that are transferred to the respective receiving means. In the example shown, the elements 3A, 3B, 3C, 3D, 3E and 3F are transported on the conveyor 1 in their compartments 2. After having been scanned by the scanning head 5, the elements are transferred to a feeding zone 10 comprising as shown in this example, the compartments 2-7, 2-8, 2-9, 2-10, 2-11 and 2-12. Conventional feeding means are provided in the feeding zone 10 which feed the waste elements from the successive compartments into the receiving means 12A, 12B, 12CF, 12D, 12D', 12E. The receiving means may have a form of containers, channels, conveyors etc. The means feeding the elements are controlled basing on the signals coming from the control unit. The waste elements 3A are fed to the conveyor 12A and may be transferred on in order to separate their tobacco parts from the filter parts, and the elements 3B are placed on the conveyor 12B. On the other hand, the elements 3D scanned to be positioned with their filter parts on the left or the right side as seen on the figure, are fed to the conveyors 12D and 12D'. Due to the uniform orientation of the elements 3D, they may be fed directly to a cutting assembly in order to have their tobacco parts separated from their filter parts. The elements 3C and 3F are fed to the container 12CF, while the elements 3E are fed to the container 12E, From the compartments where different types of waste elements 3 are detected in one compartment, as e.g. in the compartments 2-4 and 2-6 on the figure, the elements are not removed but they are returned into the chute in order to be placed back on the conveyor 1 upstream the scanning head.

Figure 10:
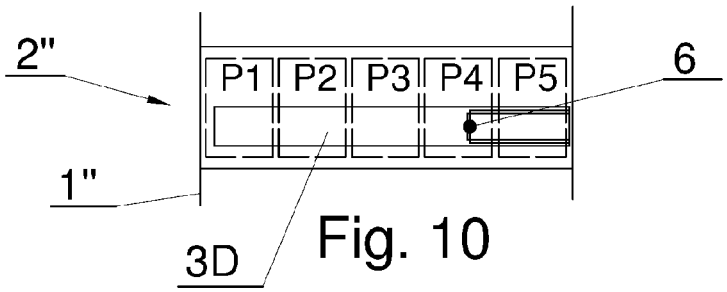
FIGS. 10-13 show examples of conveyor compartments.
Figure 11:
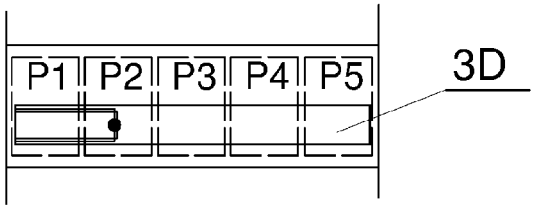
Figure 12:
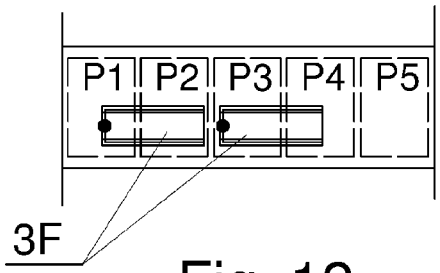
Figure 13:
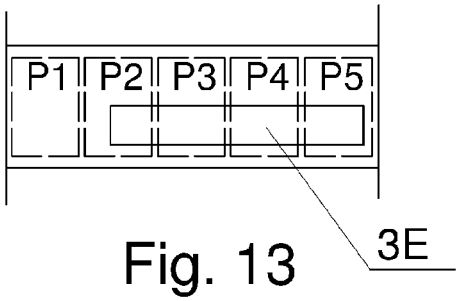

FIGS. 10 to 13 show the compartments 2" according to another embodiment, in which the rod-like elements of the type 3D, 3E and 3F are sorted out. In the situation as shown in FIG. 10 all the scanning sections 5' of the scanning head 5, namely the sections P1, P2, P3, P4 and P5 will detect the presence of the element 3D, the section P4 will detect the presence of the indicator 6, the sections P4 and P5 will detect the presence of the filter part. The position of the element 3D in FIG. 11 is opposite to the one of FIG. 10. The indicator 6 is detected by the section P2, and the filter part by the sections P1 and P2. The scanning head 5 of the FIG. 12 detects two filter parts, while the sections P2 and P5 of FIG. 13 detect the presence of the element 3E. In the zone 10 (FIG. 14), conventional feeding means are provided, for feeding the waste elements from the successive compartments into the conveyors or channels 11C, 11D, 11D', 11E feeding the elements into the receiving means 12A, 12B, 12CF, 12D, 12D', 12E. The elements 3D on the conveyor 1", scanned to be positioned with their filter parts on the left or the right side as seen in the figure, are fed to the conveyors 13D and 13D'. Due to the uniform orientation of the elements 3D, they may be fed directly to a cutting assembly in order to have their tobacco parts separated from their filter parts. The elements 3C are fed to the container 13C, while the elements 3E are fed to the container 13E.

Figure 14:
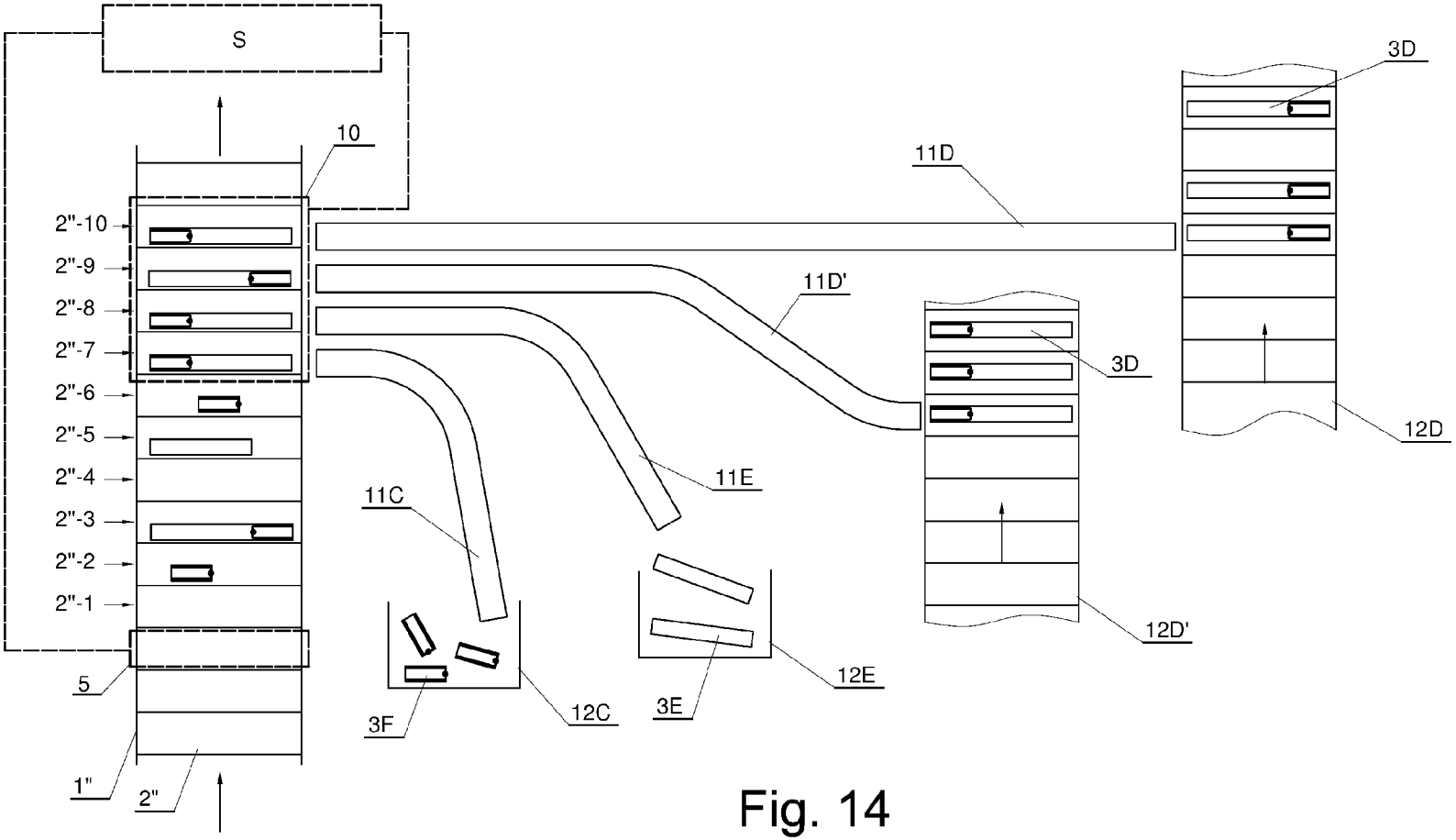
FIG. 14 shows another exemplary embodiment of the system according to the invention.

FIG. 14 illustrates another exemplary embodiment of the system according to the invention, in which the elements 3D, 3E i 3F are transported on the conveyor 1" in the compartments 2". After having been scanned by the scanning head 5, the elements are transferred to the feeding zone 10 comprising as shown in this example, the compartments 2"-7. 2"-8, 2"-9 i 2"-10. This example shows the sorting out of the waste elements 3 consisting at most of one filter part and one tobacco part. Conventional feeding means are provided in the feeding zone 10 which feed the waste elements from the successive compartments 11C, 11D, 11D', 11E into the receiving means 12C, 12D, 12D', 12E. The elements 3D scanned to be positioned on the conveyor 1" with their filter parts on the left or the right side as seen in the figure, are fed to the conveyors 12D and 12D'. Due to the uniform orientation of the elements 3D, they may be fed directly to a cutting assembly in order to have their tobacco parts separated from their filter parts. The waste elements 3F are fed to the container 12C, while the elements 3E are fed to the container 12E.

Figure 15:
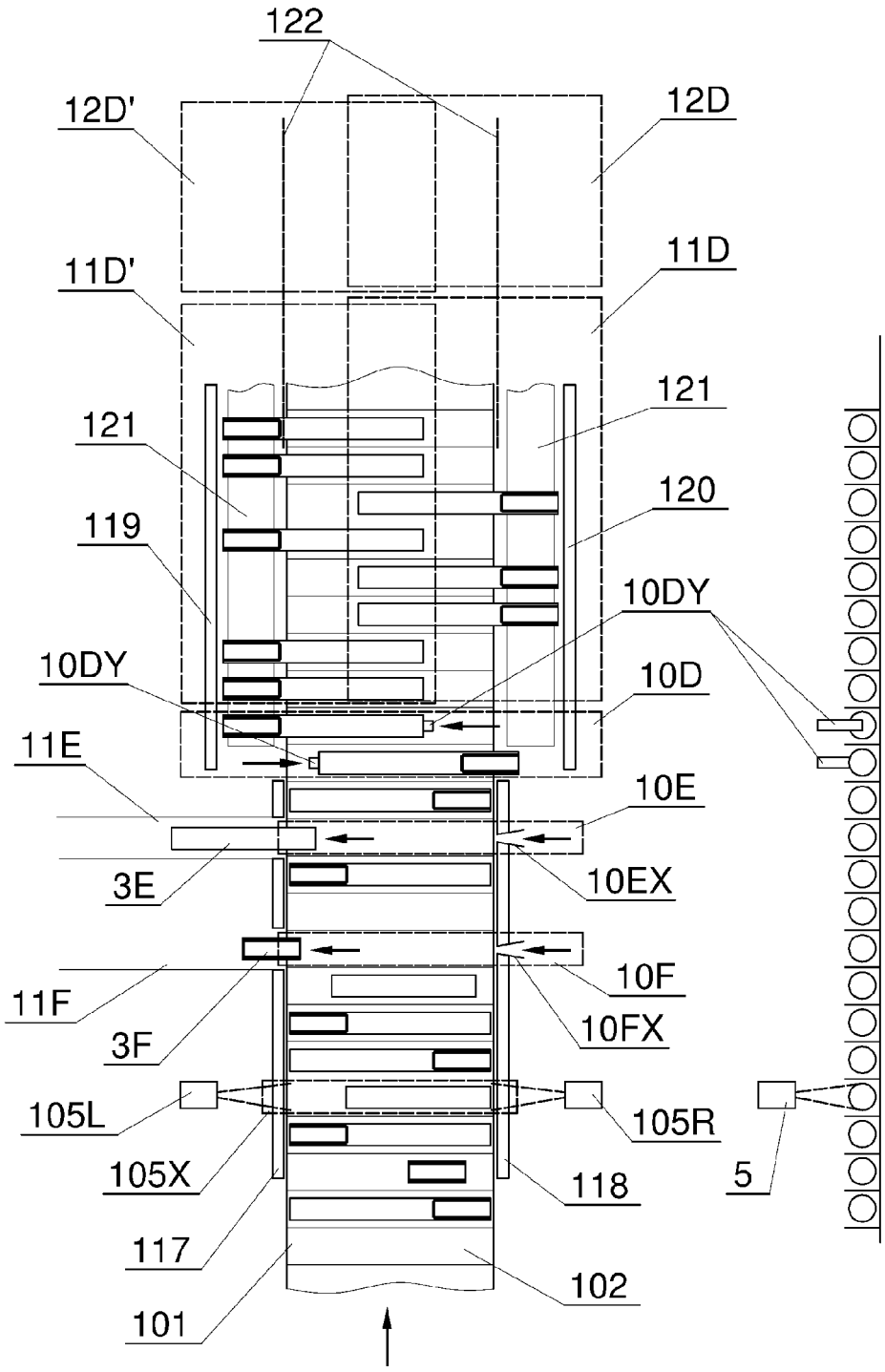
FIGS. 15-19 show some other exemplary embodiments of the system according to the invention.

FIG. 15 illustrates another exemplary embodiment of the system for performing the method for arranging the rod-like waste elements 3 placed on the conveyor 101 provided with the compartments 102. This example shows the sorting out of the waste elements 3 consisting at most of one filter part and one tobacco part.

The scanning head 5 comprising a plurality of scanning sections 5' is oriented along the compartments 102, the area of scanning of the scanning head being indicated by the reference 105X. In this exemplary embodiment the scanning head is equipped with additional sections 105R and 105L directed towards the endings of the waste elements 3, the function of the additional scanning section being to analyze the color or the density of the waste elements 3. Basing on the scanning, the data informing of the number and contents of the successive compartments is assigned to the respective compartments and stored in the control unit in order to sort out the waste elements by feeding them into suitable receiving means. The conveyor 101 is moving upwards (in the figure) transferring the successive compartments 102 through the zones of operation of the means feeding the elements from the successive compartments into the suitable receiving means. The elements are led in the compartments between the lateral guides 117 and 118. The feeding means constituted of compressed air nozzles 10FX provided in the feeding zone 10F, transfer the waste elements 3F from the successive compartments into the conveyor or channel 11F, from which the elements 3F are delivered to the receiving means 12F (not shown); the receiving means may have a form of containers, channels or conveyors etc. The flow direction of the compressed air from the nozzle located in the lateral guide wall is shown by the arrows directed towards the conveyor or channel 11F. In the feeding zone 10E feeding means constituted of the compressed air nozzles are located, that deliver the waste elements 3E from the successive compartments into the conveyor or channel 11E feeding the elements 3E into the receiving means 12F (not shown), the receiving means may have a form of containers, channels or conveyors etc. As in the case of the elements 3F, the flow direction of the compressed air moving the elements 3E is shown by the arrows. The signals used for controlling the nozzles 10FX and 10EX come, as in the above described examples, from the control unit (not shown). The feeding zone 10D constitutes the area of operation of the means in the form of pushers 10DY, feeding the rod-like waste elements 3D. Depending on the information concerning the waste elements 3D and stored during the scanning, namely the positioning of their filter parts, the elements are transferred to the left or to the right (on the figure) into the suitable lateral guides 119 and 120. The operation of the pushers results in locating the elements 3D in two channels 11D and 11D' which may be overlapping each other so that the elements 3D are partially supported by the elements 121, and may also be spaced so as not to overlap. The supporting elements 121 may also have a form of conveyors moving with a speed equal to the speed of the conveyor 101. The receiving means 12D and 12D' may be located so that they form extensions of the channels 11D i 11D' and within the receiving means cutting means may be provided for separating the tobacco parts from the filter parts by cutting the elements 3D along the line 122. Disc cutting knives, straight line knives, laser or water stream knives etc. may be used.

Figure 16:
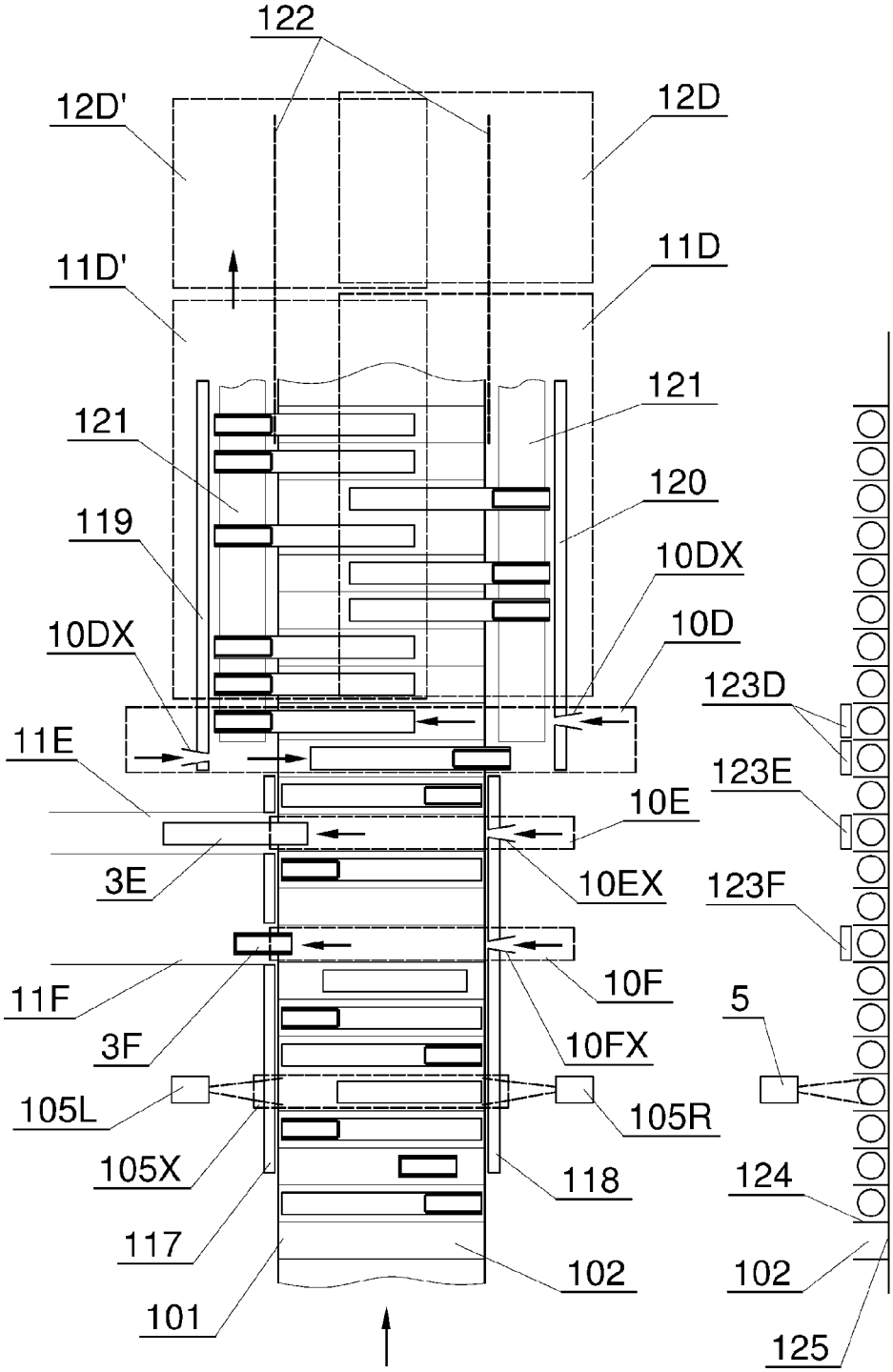

FIG. 16 shows an example similar to that of FIG. 15, the elements 3D being transferred in the zone 10D to the left or to the right by the feeding means in the form of the compressed air nozzles 10DX. In order to increase the effectiveness of the transfer of the elements 3F, 3E and 3D in the zones 10F, 10E and 10D, the elements 123F, 123E and 123D are used covering the compartments 102 and causing the compressed air to be delivered to the channels formed by the walls 124 and the bottom 125 of the compartments 102 and the respective element 123F, 123E or 123D.

Figure 17:
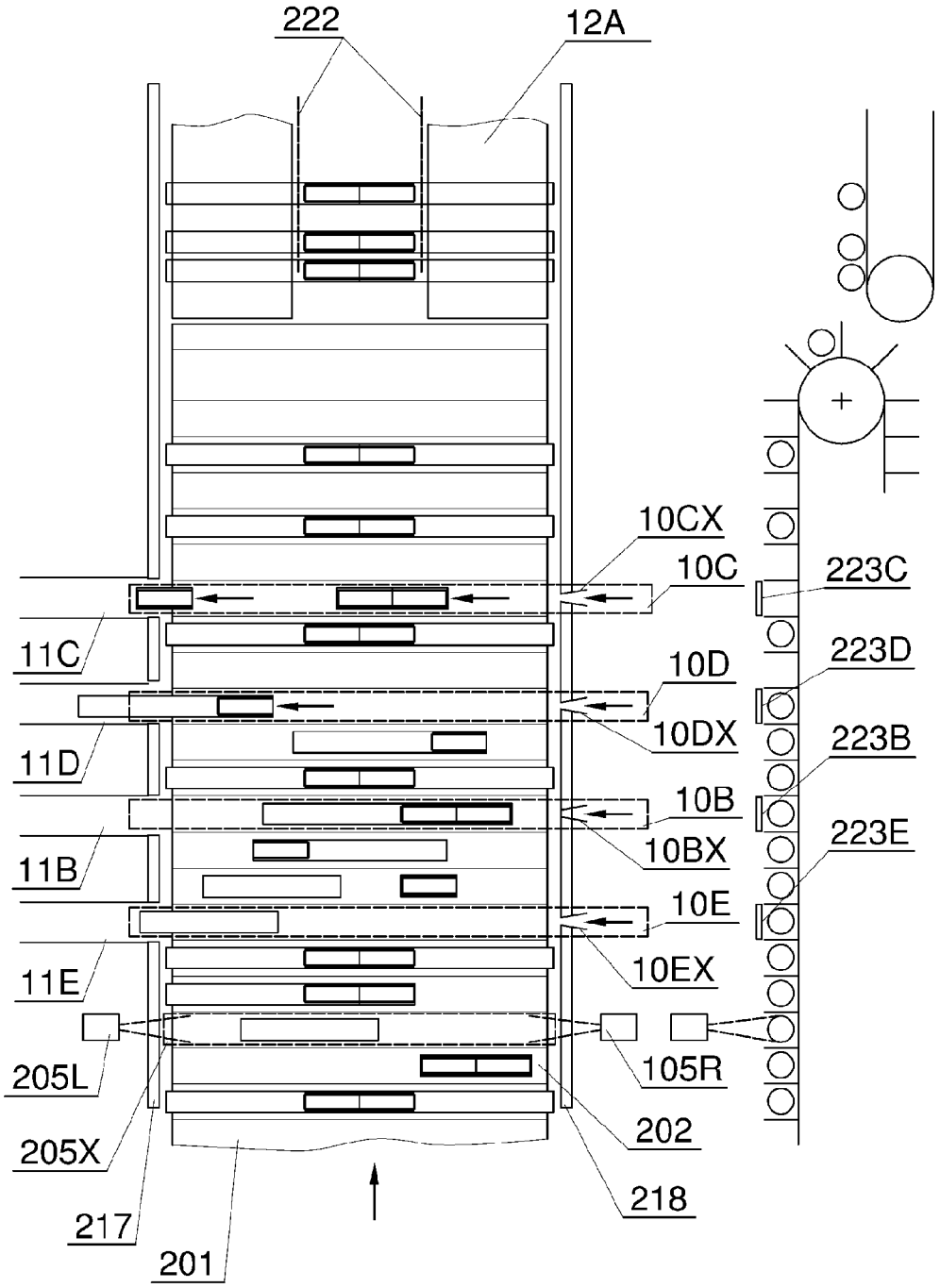

FIG. 17 illustrates another exemplary embodiment of the system for for arranging the rod-like waste elements 3, adapted for sorting out the elements consisting at most of two tobacco parts and two filter parts. The waste elements 3 are transported on the conveyor 201 provided with compartments 202, The scanning head 5 comprising a plurality of scanning sections 5' is located along the compartments 202, the area of scanning of the scanning head is indicated by the reference 205X. In this exemplary embodiment the scanning head is also equipped with additional sections 205R and 205L directed towards the endings of the waste elements 3, the function of the additional sections being the analysis of the color and the density of the waste elements 3. Basing on the scanning, the data informing of the number and contents of the successive compartments is assigned to the respective compartments and stored in the control unit in order to sort out the waste elements by feeding them into suitable receiving means. The conveyor 201 is moving upwards (in the figure) transferring the successive compartments 202 through the zones of operation of the means feeding the elements from the successive compartments into the suitable receiving means. The elements are led in the compartments between the lateral guides 217 and 218, Feeding means in the form of compressed air nozzles 10EX located in the side guide 218 are provided in the feeding zone 10E, feeding the waste elements 3E from the successive compartments into the conveyor or channel 11E, from which the elements 3E are delivered to the receiving means 12E (not shown), the receiving means may have a form of containers, channels or conveyors etc. Feeding means in the form of compressed air nozzles 10BX located in the side guide 218 are provided in the feeding zone 10B, feeding the waste elements 3B from the successive compartments into the conveyor or channel 11B, from which the elements 3B are delivered to the receiving means 12B (not shown). Similarly, feeding means in the form of compressed air nozzles 10DX located in the side guide 218 are provided in the feeding zone 10D, feeding the waste elements 3D from the successive compartments into the conveyor or channel 11D, from which the elements 3D are delivered to the receiving means 12D (not shown). In the last feeding zone 10C feeding means in the form of compressed air nozzles 10CX located in the side guide 218 are provided in the feeding zone 10C, feeding the waste elements 3C from the successive compartments into the conveyor or channel 11C, from which the elements 3C are delivered to the receiving means 12C (not shown). The signals used for controlling the feeding means in the form of the nozzles 10EX, 10BX, 10DX and 10CX come from the control unit (not shown) and are generated basing on the information gathered by the scanning head 205. The zones 10E, 10B, 10D and 10C are provided with the covering elements 223E, 223B, 223D i 223C for increasing the effectiveness of rejecting the elements by means of the compressed air. The waste elements 3A, positioned so that they may undergo cutting by the cutting assembly along the line 222 in order to separate their tobacco parts from their filter parts, are transferred on to the receiving means 12A.

Figure 18:
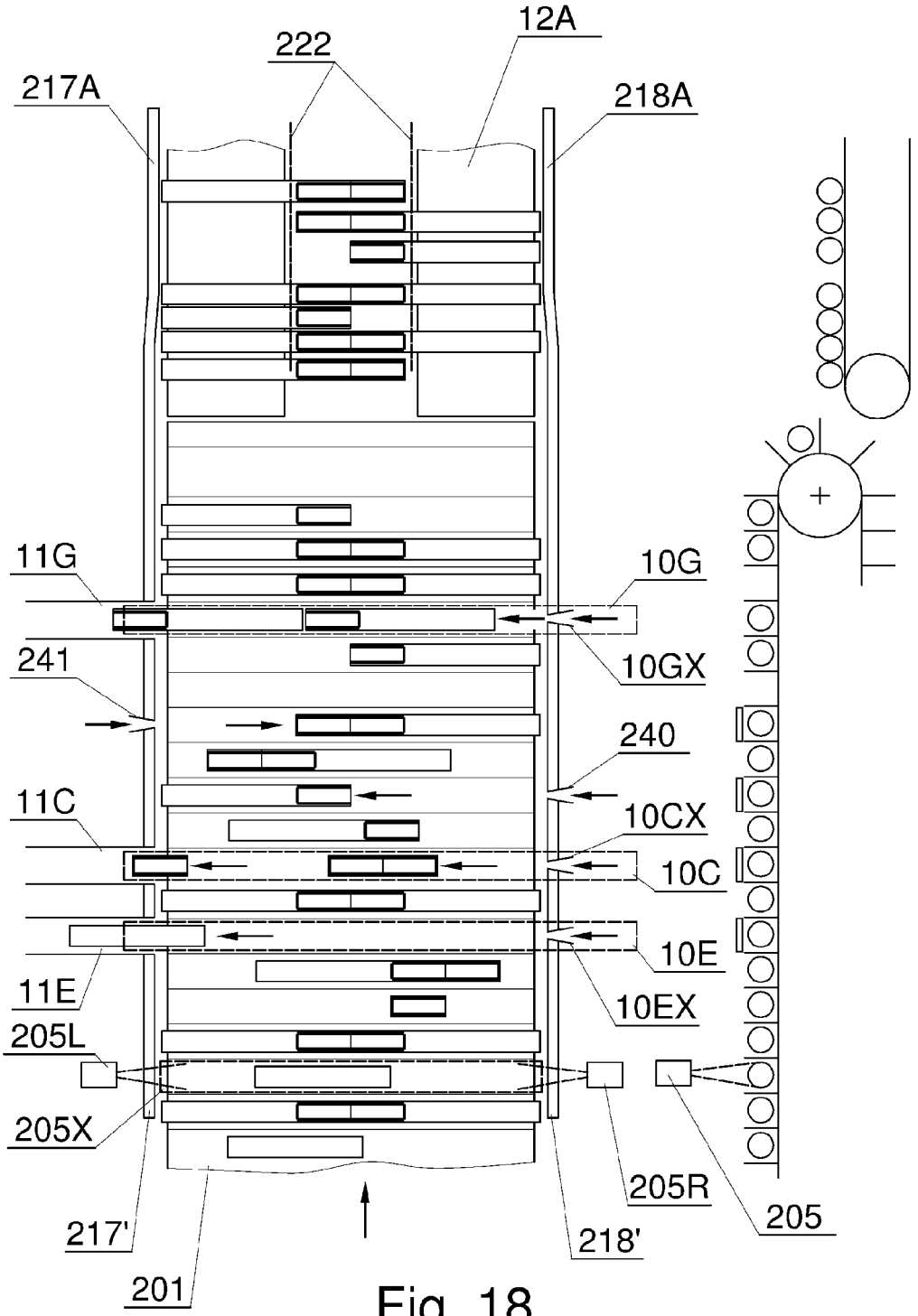

A similar example is shown in FIG. 18. Feeding means in the form of nozzles 10EX and 10CX are provided in the feeding zones 10E and 10C, feeding the elements 3E, 3C and 3F to the channels or conveyors 11E and 11C. On the other hand, the waste elements 3B and 3D, having their filter parts directed to the right in the figure, are shifted as far as the lateral guide 217' by means of the compressed air nozzle 240. The waste elements 3B and 3D, having their filter parts directed to the left in the figure, are shifted as far as the lateral guide 218' by means of the compressed air nozzle 241. The waste elements 3D oriented uniformly are rejected in the zone 10G; other elements of various types located in one compartments may also be rejected in this zone. The elements rejected in this zone are placed back on the conveyor 201, upstream the scanning area 205X. The conveyor 201 transfers the elements remaining in its compartments as far as the area 12A where the tobacco parts may be separated from the filter parts along the line 222. Precision of the cutting may be improved by reducing the distance between the endings of the guides 217A and 218A in relation to the distance between the endings of the guides 217' and 218' which results in reduction of the play within which the elements may be positioned in the compartments.

Figure 19:
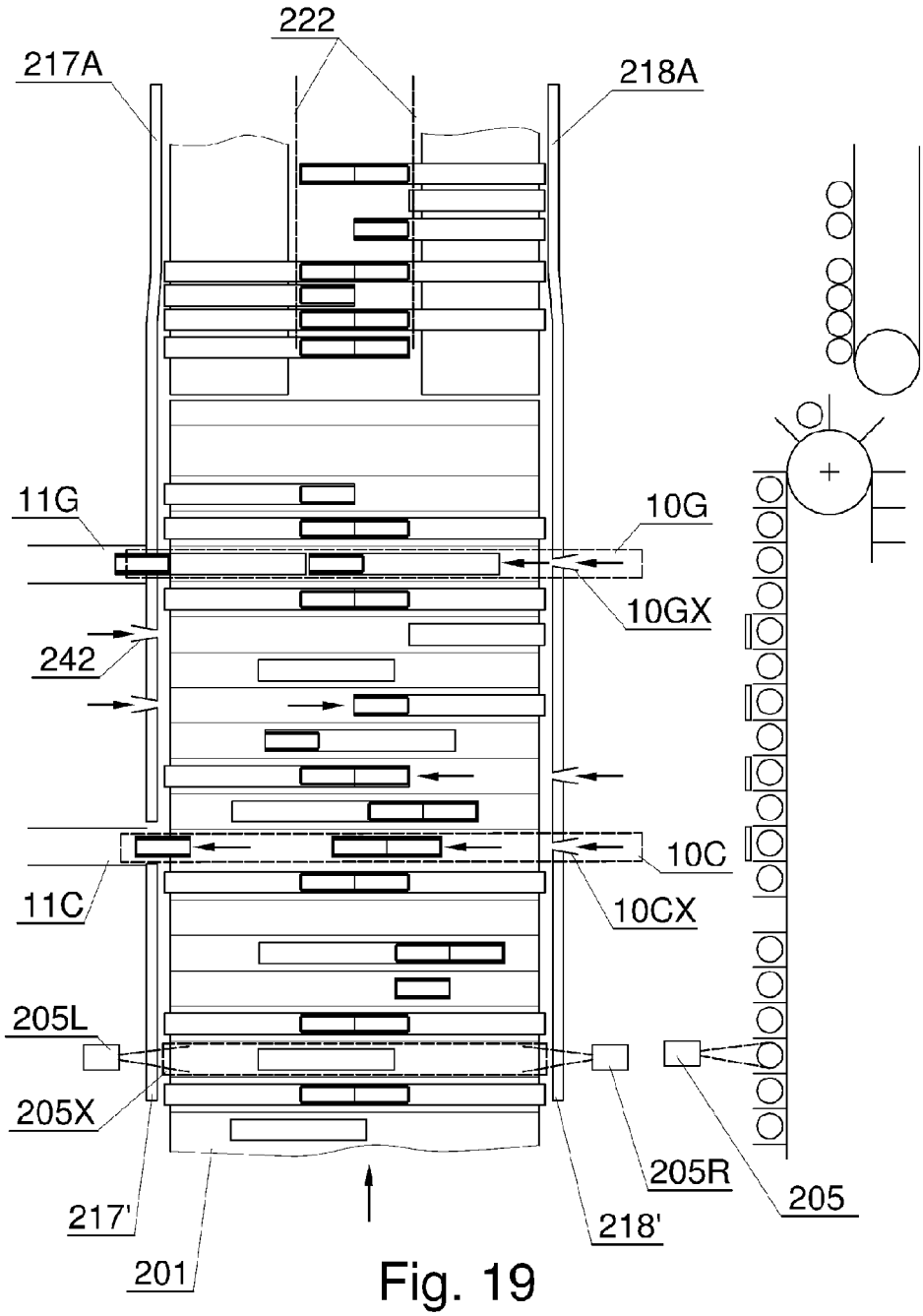

In the example shown in FIG. 19 the elements 3E are not transferred by the channel or conveyor 11E, but they are shifted as far as the guide 218' by the nozzle 242.

The invention claimed is:

1. A method for arranging rod-like elements, wherein said rod-like elements are composed each of at least one part selected from a group including cigarette parts being filter parts and tobacco parts;

wherein an unordered portion of the rod-like elements is delivered to a conveyor for transporting the elements on said conveyor, said elements being arranged in a plurality of compartments on the conveyor;

the elements are arranged longitudinally in each compartment and transversely to the direction of movement of the conveyor;

wherein the compartments include a length adapted to receive at least one filter part and at least one tobacco part of a cigarette;

determining a type, number of parts each element is composed of, and location of each part of the elements received in each successive compartment by at least a single scanning of each successive compartment of the conveyor;

the scanned results are transmitted to a control unit that assigns each compartment information according to its contents; and subsequently sorting the elements based on the information received from the control unit by the type, the number of parts each element is composed of, and the location of the parts in each compartment by transferring the elements contained in successive compartments to a predetermined receiving means.

2. Method according to claim 1, wherein each compartment of the conveyor has a length which comprises a multiple of a sum of the length of the filter part and the tobacco part of an element.

3. Method according to claim 1, wherein the scanning is performed by a longitudinal scanning head that is immovably located above the conveyor and that extends in a direction along the compartments.

4. Method according to claim 1, wherein the scanning of each compartment is effected by a separate scanning of its individual adjoining sectors, wherein each sector has a length equal at most to the length of the filter part of a cigarette.

5. Method according to claim 1, wherein each compartment is scanned more than once by means of a sliding scanning head that moves above the conveyor and along the conveyor.

6. Method according to claim 1, further comprising a scanning head that enables the detection of at least one feature selected from a group consisting of: (a) the presence or absence of an element in a compartment; (b) the external color of the element; (c) the density of the contents of the element; (d) the contrast of the scanned elements, and (e) the presence of a detectable indicator on the element.

7. Method according to claim 1, wherein successive rod-like elements are sorted to a suitable receiving means by transferring the elements in separate chambers of the receiving means, wherein the chambers for receiving the elements being selected from groups of elements, the groups consisting of: (a) elements composed of two tobacco parts combined with two filter parts; (b) elements composed of one tobacco part combined with two filter parts, wherein the tobacco part is located on a first side of the compartment; (c) elements composed of one tobacco part combined with two filter parts, wherein the tobacco part is located on a second side opposite the first side of the compartment, (d) elements composed exclusively of filter parts connected with each other; (e) elements composed of one tobacco part combined with one filter part, wherein the tobacco part is located on a first side of the compartment, (f) elements composed of one tobacco part combined with one filter part, wherein the tobacco part is located on a second side opposite the first side of the compartment; (g) elements consisting of just one tobacco part, and returning the elements in the compartments back on the conveyor when more than one element is detected in a compartment.

8. Method according to claim 1, wherein the elements are transferred to the receiving means by a feeding means comprising compressed air nozzles or pushers.

9. System for arranging rod-like elements composed each of at least one part selected from a group including cigarette parts being filter parts and tobacco parts, comprising a conveyor on which an unordered portion of the rod-like elements is delivered, the conveyor enabling arrangement of the elements in a plurality of compartments, longitudinally in each compartment and transversely to the direction of movement of the conveyor, the compartments having a length for receiving at least one filter part and at least one tobacco part of a cigarette, wherein a scanning means is located above the conveyor enabling at least a single scanning of each successive compartment of the conveyor and definition of the type, the number and the location of the parts of an element received in each successive compartment, the system being further provided with a control unit assigning each compartment information about its contents, and wherein the system is further provided with feeding means and receiving means for the elements which are sorted out based on the information received from the control unit, by the type and the number of the parts an element is composed of, as well as by the location of these component parts within the compartment, the feeding means and the receiving cooperating with the control unit.

10. System according to claim 9, wherein the conveyor is a belt conveyor or a drum conveyor.

11. System according to claim 9, wherein the control unit is a programmable controller or an industrial computer.

12. System according to claim 9, wherein the scanning means is a longitudinal scanning head located immovably above the conveyor and extending in a direction along the compartments.

13. System according to claim 9, wherein each compartment of the conveyor has a length that is able to receive at most one filter part and one tobacco part of an element.

14. System according to claim 9, wherein each compartment of the conveyor has a length which comprises a multiple of a sum of the length of the filter part and the tobacco part of an element.

15. System according to claim 9, wherein the scanning means is a sliding scanning head that is movable above the conveyor and along it.

16. System according to claim 9, wherein the scanning head comprises a plurality of scanning sections; wherein each scanning section comprises a sensor for detecting at least one feature selected from a group of features consisting of: (a) the presence or absence of an element in a compartment; (b) the external color of the element; (c) the density of the contents of the element; (d) the contrast of the scanned elements; and (e) the presence of a detectable indicator on the element.

17. System according to claim 9, wherein the receiving means comprise containers, receiving channels or conveyors into which the elements are fed from the individual compartments of the conveyor via the channels.

18. System according to claim 9, wherein the receiving means comprise separate chambers collecting the elements selected from groups of elements, the groups consisting of: (a) elements composed of two tobacco parts combined with two filter parts; (b) elements composed of one tobacco part combined with two filter parts, wherein the tobacco part is located on a first side of the compartment; (c) elements composed of one tobacco part combined with two filter parts, wherein the tobacco part is located on a second side opposite the first side of the compartment; (d) elements composed exclusively of filter parts connected with each other; (e) elements composed of one tobacco part combined with one filter part, wherein the tobacco part is located on a first side of the compartment; (f) elements composed of one tobacco part combined with one filter part, wherein the tobacco part is located on a second side opposite the first side of the compartment, and (g) elements composed exclusively of tobacco parts.

19. System according to claim 9, wherein the feeding means comprise compressed air nozzles.

20. System according to claim 14, wherein it is associated with a cutting unit for separating the tobacco parts from the filter parts.

* * * * *